US005183118A

United States Patent [19]

Kershaw et al.

[11] Patent Number: 5,183,118

[45] Date of Patent: Feb. 2, 1993

[54] HIGH-CAPACITY BALLAST RECONDITIONING APPARATUS

[75] Inventors: John K. Kershaw; Philip C. McCray, both of Montgomery, Ala.

[73] Assignee: Knox Kershaw, Inc., Montgomery, Ala.

[21] Appl. No.: 786,176

[22] Filed: Oct. 31, 1991

Related U.S. Application Data

[63] Continuation-in-part of Ser. No. 590,030, Sep. 28, 1990, Pat. No. 5,109,775.

[51] Int. Cl.[5] ..... E01B 27/00

[52] U.S. Cl. ..... 171/16; 104/2

[58] Field of Search ..... 171/16; 37/104, 106; 104/2

[56] References Cited

U.S. PATENT DOCUMENTS

| | | | |
|---|---|---|---|
| 4,534,415 | 8/1985 | Theurer et al. | 171/16 |
| 4,705,115 | 11/1987 | Whitaker, Jr. | 104/2 |
| 4,813,488 | 3/1989 | Theurer | 171/16 |
| 4,850,123 | 7/1989 | Whitaker, Jr. | 171/16 |
| 5,029,649 | 7/1991 | Kershaw et al. | 171/16 |
| 5,084,989 | 2/1992 | Theurer et al. | 171/16 |
| 5,094,018 | 3/1992 | Theurer et al. | 104/2 |
| 5,109,775 | 5/1991 | Kershaw et al. | 104/2 |

FOREIGN PATENT DOCUMENTS

| | | | |
|---|---|---|---|
| 2194982 | 9/1986 | United Kingdom | 104/2 |

*Primary Examiner*—David H. Corbin
*Assistant Examiner*—Spencer Warnick
*Attorney, Agent, or Firm*—Phillips & Beumer, P.C.

[57] ABSTRACT

Apparatus for excavating ballast from adjacent to the ends of and beneath the cross ties of a railroad bed and for cleaning the excavated ballast for return thereof to the railroad bed. The apparatus includes a vehicle for supporting a pair of excavating assemblies on opposite sides of the vehicle. Each excavating assembly includes a pair of spaced excavating wheels for excavating ballast from adjacent to the opposite sides of the cross ties and an undercutter for excavating ballast from beneath the cross ties at opposite ends thereof. A discrete cleaning station is provided for each excavating wheel to receive and clean the ballast picked up by each excavating wheel. Means are provided for conveying and discharging the cleaned ballast back onto the railroad bed.

17 Claims, 2 Drawing Sheets

HIGH-CAPACITY BALLAST RECONDITIONING APPARATUS

CROSS OF RELATED APPLICATION

This application is a continuation-in-part of application Ser. No. 07/590,030, filed Sep. 28, 1990, and now U.S. Pat. No. 5,109,775, patented May 5, 1992.

FIELD OF THE INVENTION

The present invention relates generally to the field or railroad maintenance and particularly to a high-capacity apparatus for the rapid and facile reconditioning of ballast along the shoulders of railroad track beds.

BACKGROUND OF THE INVENTION

Railroad ballast cleaning machinery is well known in the art. These machines take up the ballast from the track bed clean the ballast, return the cleaned material to the track, and discard the "dirt" or waste contaminating material. One reason for cleaning the ballast is to provide cleaner ballast which can drain water away from the railroad cross ties in order to ensure a longer "life" for the ties. Over a period of time, the track bed becomes contaminated by mud working its way up from underneath, by dirt getting into the ballast from the top, or by the ballast being slowly ground into small particles by vibration caused as trains pass over the ballast. The ballast becomes so contaminated after a period of time that moisture is held around the ties, thus resulting in deterioration of the ties, which results in expensive tie replacement becoming necessary. Thus periodic ballast cleaning is necessary to ensure good drainage. A further disadvantage of contaminated ballast is that the track tends to settle in muddy spots, thus destroying the alignment (line) and surface of the rails.

Some types of ballast cleaners are disclosed in U.S. Pat. Nos. 4,705,115, issued on nov. 10, 1985, to John B. Whitaker, Jr.; 4,850,123, issued on Jul. 25, 1989, to John B. Whitaker, Jr.; 4,534,415, issued on Aug. 13, 1985, to Josef Theurer; and 4,813,488, issued on Mar. 31, 1989, to Josef Theurer. Typically, there are two types of ballast cleaners. One type simply takes up the ballast along the track shoulders (outside the ends of the cross ties) and is known as a "shoulder cleaner." The second type takes up the material underneath and between the cross ties and is known as an "undercutter cleaner."

Normally, a shoulder cleaner utilizes a rotating "ditcher wheel" on each side to take the ballast up from the track shoulder while an undercutter uses a continuous cutter chain to pull the material from underneath the track.

Two of the above-identified patents (4,534,415 and 4,813,488) relate to an undercutter type of apparatus which utilizes a chain-type excavator which requires that the track be raised for the excavation of the ballast. After the ballast cleaning operation is completed, the tracks must be levelled in an attempt to restore the original track line.

A typical ballast reconditioning apparatus which uses a ditcher wheel and undercutter configuration is disclosed in U.S. Pat. No. 4,850,123. The patent is directed to a pair of rotatable undercutters and means for raising, lowering, and horizontally moving the undercutters. The patent also discloses a ditcher wheel mounted forwardly of the undercutters to remove ballast from the shoulders of the railroad bed and a single cleaner screen for cleaning the ballast. In this type of apparatus, forward progress is limited by the speed at which the ballast can be cleaned by the single screen cleaner. Furthermore, the contaminated ballast removed by the undercutter is deposited at the shoulders of the railroad bed (uncleaned) while the ballast removed from the shoulders of the bed by the ditcher wheels are transported to a single cleaning station having a vibrating screen assembly therein. If it is desirable to remove the uncleaned deposited ballast from the shoulders for cleaning, it is necessary for the ditcher wheels to be raised so that the apparatus can be reversely moved over the excavated area of the railroad bed and another pass made to pick up the deposited ballast from the shoulders by the ditcher wheels.

As can be seen, the production rate of such apparatus is unduly restricted if all of the excavated ballast is to be reconditioned. The rate and amount of ballast cleaning is severely limited since only a single cleaning station is provided. Also, the requirement for repeated passes over the area to recondition all of the excavated ballast is time consuming (and costly).

U.S. Pat. No. 4,705,115 discloses a ballast reconditioning system having two ditcher wheels, one on each side of the vehicle frame, and an undercutter mounted rearwardly of each ditcher wheel to remove ballast from beneath the tracks. The ballast removed from the shoulders of the railroad bed by the ditcher wheels is transported rearwardly of the undercutter to be directly discharged (without cleaning) onto the center of the track to replace the ballast removed by the undercutter. The apparatus of U.S. Pat. No. 4,705,115 uses conveyor belts to transport the ballast picked up by the ditcher wheels to the rear of the undercutter and onto the center of the track and also to transport the ballast picked up by the undercutter to the single ballast screen cleaner. A clean ballast return receives the cleaned ballast and returns it to the shoulders of the railroad bed.

The forward speed of the apparatus is severely limited since only a single ballast screen is provided for cleaning the ballast picked up by the undercutter device. Furthermore, it should be noted that the shoulder ballast which is returned (uncleaned) to the center of the track still contains a large amount of contaminants such as mud, small dust particles, etc., and will not provide the high degree of drainage afforded by a track bed having clean shoulder ballast. As a result of not cleaning all of the excavated ballast in a single operation, more frequent periodic maintenance of the railroad track is required.

Structure is disclosed in our U.S. Pat. No. 5,029,649, issued Jul. 9, 1991 (incorporated herein by reference), which is directed to a ballast reconditioning system which uses two discrete pairs of ditcher wheels and an associated single cleaning station for the ballast picked up by each pair of ditcher wheels. Such structure, while more efficient than heretofore known systems, still has the defect of being slowed down because of the cleaning limitations imposed by the use of a single cleaning station for each pair of ditcher wheels.

Apparatus of the present invention overcomes the noted difficulties by providing a ballast system which uses two pairs of ditcher wheels to pick up ballast from a railroad track and four cleaning stations. Each ditcher wheel is provided with its own cleaning station and means for transporting the cleaned ballast back to the railroad bed. Additionally, an undercutter device for cleaning ballast from beneath the tracks is provided intermediate the ditcher wheels of each pair of ditcher wheels. One pair of ditcher wheels and an undercutter device are mounted on a first side of a vehicular frame, and the second pair of ditcher wheels and the second undercutter are mounted on the opposite side of the vehicular frame. Conveyor systems carry the dirty ballast to the cleaning stations and also convey the cleaned ballast back onto the railroad bed.

SUMMARY OF THE INVENTION

It is, therefore, an object of the present invention to provide apparatus for removing and cleaning ballast from the shoulders of a railroad track bed.

It is a further object of the present invention to provide such apparatus with means for removing, cleaning, and replacing such ballast in a rapid and facile manner.

It is still a further object of the present invention to provide such ballast cleaning apparatus with means for simultaneously removing ballast from under the cross ties and picking up ballast from the shoulder of the ballast bed while cleaning and replacing the removed ballast.

A feature of the present invention is the provision of a ballast removal, cleaning, and replacement system wherein a first pair of ballast removal devices (ditcher wheels) are provided in spaced relation on one side of a vehicular frame means and a second pair of ballast removal devices (ditcher wheels) are provided in spaced relation on the opposite side of the frame means. Each ballast removal device (ditcher wheel) is provided with its own cleaning station, which cleans the ballast which is picked up by its associated ditcher wheel. A "ditcher wheel" is defined as a rotatable annular member having buckets spaced around the periphery thereof which scoop up the ballast on the shoulders of the railroad bed and empties the ballast at approximately the uppermost portion of its circular movement.

DESCRIPTION OF THE PREFERRED EMBODIMENT

Figure 1:
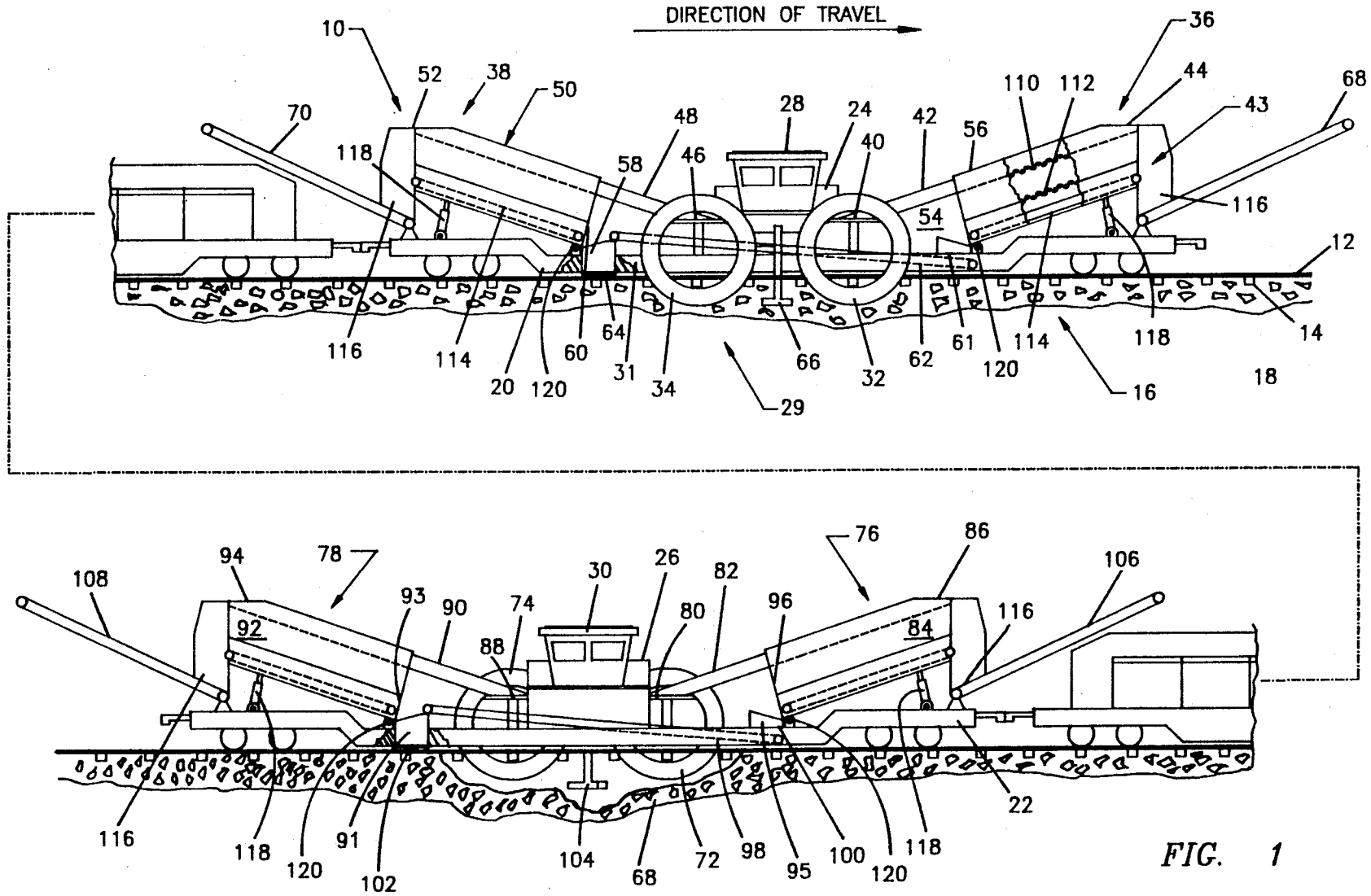
FIG. 1 is an elevational view of the ballast removal, cleaning, and replacement system of the present invention.
Figure 2:
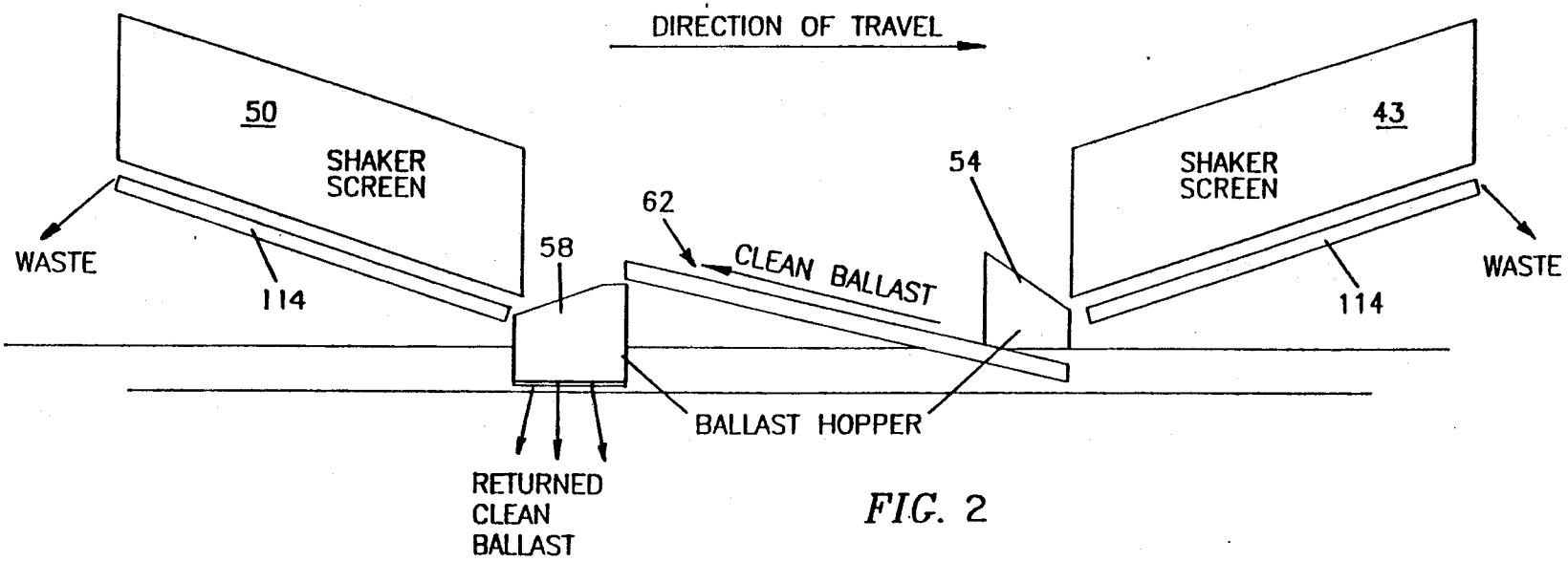
FIG. 2 is a diagrammatic view of the system of FIG. 1.

As seen in FIG. 1, a ballast reconditioning apparatus 10 is shown supported on a track 12 attached to cross ties 14 Which are supported on a bed 16 comprised of ballast 18. Reconditioning apparatus 10 includes a vehicular carrying structure shown as a pair of vehicle frames 20 and 22 having power units 24 and 26, respectively, which not only provides the means to propel the system but may also provide the motive power for driving various components of the system. A pair of cabs 28 and 30 are, respectively, provided to enclose an operator, and each cab is provided with conventional control mechanisms which are conventionally connected to the various components for operation thereof.

Frame 20 is shown to support a first pair of ditcher wheels 29 which are mounted in spaced relation on a first side 31 of frame 20. The first pair of ditcher wheels includes a forward ditcher wheel 32 and a rear ditcher wheel 34. A first ballast cleaning station 36 is associated with and positioned in the general vicinity of ditcher wheel 32, and a second cleaning station 38 is associated with and disposed in the general vicinity of ditcher wheel 34. A first transverse conveyor belt arrangement 40 is provided to receive the removed ballast from ditcher wheel 32 and to transport the ballast to a longitudinally extending conveyor belt 42 which unloads the ballast into a first cleaning station enclosure 43 at the end 44 thereof. A second transverse conveyor belt arrangement 46 is provided to receive the removal ballast from ditcher wheel 34 and to transport the ballast to a longitudinally extending conveyor belt 48 which unloads the ballast into a second cleaning station enclosure 50 at the end 52 thereof.

A first hopper 54 is mounted adjacent to the end 56 of enclosure 43 of cleaning station 36 to receive cleaned ballast therefrom and to direct this ballast to a second hopper 58 which is positioned adjacent to an end 60 of enclosure 50 of cleaning station 38. The second hopper 58 receives ballast directly from enclosure 50 and also from enclosure 43 via a conveyor system 62 which is mounted in communication with hopper 54 and hopper 58. As seen in FIG. 1, hopper 54 includes a closure member 61 at the bottom thereof which may be hydraulically actuated to open and close the bottom of the hopper to control the flow of ballast out of the hopper. Hopper 58 includes a similar closure member 64 to control the flow of ballast from hopper 58. Such hopper and closure members are disclosed in our U.S. Pat. No. 5,029,649, issued Jul. 9, 1991.

An excavating member 66 which may be similar to that disclosed in the aforementioned U.S. Pat. No. 5,029,649, is mounted between excavating wheels 32 and 34 to extend beneath the cross ties and excavate ballast therefrom. Also, as disclosed in the aforementioned U.S. Pat. No. 5,029,649, a swing pair of waste conveyor assemblies 68 and 70 are provided to discharge waste, respectively, from enclosures 43 and 50.

Similar structure is shown mounted on frame 22 except that the ditcher wheels and the excavating member are shown mounted on the side of frame 22, which is opposite to side 31 of frame 20.

Frame 22 is shown supporting a second pair of ditcher wheels 68 which are mounted in spaced relation on the opposite side of frame 22. The second pair of ditcher wheels includes a forward ditcher wheel 72 and a rear ditcher wheel 74. A third ballast cleaning station 76 is associated with and positioned in the general vicinity of ditcher wheel 72, and a fourth cleaning station 78 is associated with and disposed in the general vicinity of ditcher wheel 74. A third transverse conveyor belt arrangement 80 is provided to receive the removed ballast from ditcher wheel 72 and to transport the ballast to a longitudinally extending conveyor belt 82 which unloads the ballast into a third cleaning station enclosure 84 at the end 86 thereof. A fourth transverse conveyor belt arrangement 88 is provided to receive the removed ballast from ditcher wheel 74 and to transport the ballast to a longitudinally extending conveyor belt 90 which unloads the ballast into a fourth cleaning station enclosure 92 at the end 94 thereof.

As seen in the drawings, a third hopper 95 is positioned adjacent to an end 96 of enclosure 84 of cleaning station 76. The third hopper 95 receives ballast directly from enclosure 84. A fourth hopper 91 is positioned adjacent to an end 93 of enclosure 92 of cleaning station 78. The fourth hopper receives ballast directly from enclosure 92 and also from enclosure 84 via a conveyor system 98 which is mounted in communication with hopper 91 and hopper 95. Hopper 95 includes a closure member 100 at the bottom thereof which may be hydraulically actuated to open and close the bottom of the hopper to control the flow of ballast out of the hopper. Hopper 91 includes a similar closure member 102 to control the flow of ballast from hopper 91 Such hopper and closure members are disclosed in our U.S. Pat. No. 5,029,619, issued Jul. 9, 1991.

A second excavating member 104 similar to that disclosed in the aforementioned U.S. Pat. No. 5,029,649 is mounted between excavating (ditcher) wheels 72 and 74 to extend beneath the cross ties and excavate ballast therefrom. Similarly, as disclosed in the aforementioned U.S. Pat. No. 5,029,649, a swing pair of waste conveyor assemblies 106 and 108 are provided to discharge waste, respectively, from enclosures 84 and 92.

It is to be understood that the cleaning stations used in the present invention are well known in the art. Each cleaning station includes one of the pivotally mounted enclosures 43, 50, 84, and 92, and each cleaning station encloses a pair of screens 110 and 112 and a conveyor belt 114 mounted beneath the screens. A vibrating mechanism (not shown but well known in the art) is disposed for vibrating the enclosures. A discharge port 116 is disposed at the rear of each cleaning station enclosure for reasons explained hereinbelow. A hydraulic piston assembly 118 is controlled by an operator in the cab to pivot the enclosure around a pivot support 120 to raise and lower the enclosures and attendant structure.

The enclosures and thus the screens carried therein have been designed to operate between 10° and 35° to provide a 25-degree operating range not found in the art. The flatter screen angle (lower elevation) is useful in extremely wet, muddy conditions, since the lower elevation permits the ballast to stay on the vibrating screen for a longer period of time, thus enabling the extremely dirty ballast to be vibrated for a longer period of time to better clean the ballast. The production rate is necessarily decreased during this time, but such procedure enables the apparatus to work on wet days (when otherwise work would be impossible). The steep angle (35°) allows maximum production when conditions are dry enough for good cleaning efficiency with a minimum of time on the screen.

The waste conveyor assemblies are provided for each cleaning station and includes conveyors 68, 70, 106, and 108 which are movable to either the rear of the vehicle frames or to the sides of the vehicle frame. The conveyors are mounted at the rear or the cleaning station enclosures beneath the discharge ports 116 of the vibrating enclosures to receive and discharge the contaminants and debris from the associated conveyor systems. The operation of the apparatus is explained herein only in conjunction with the structure of frame 20, it being understood that the structure carried on frame 22 operates in a similar manner.

Figure 3:
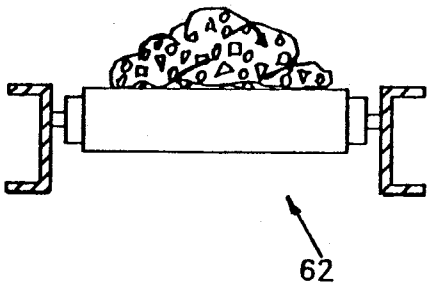
FIG. 3 is a cross-sectional view of the support structure and conveyor system for transporting the clean ballast to the rear of the support frame for directing the clean ballast onto the track bed.

FIG. 3 is a cross-sectional illustration of the longitudinally extending conveyor system which transports the clean ballast to the rear hopper whereby the clean ballast may be directed back onto bed 16.

In operation, frame 20 is propelled along the railroad track, and forward ditcher wheel 32 is rotated to remove ballast from the shoulders of the ballast bed on one side of the track. The removed ballast is emptied on transverse conveyor belt 40, which in turn empties the dirty ballast onto conveyor 42. Conveyor 42 empties the dirty ballast into upper end 44 of enclosure 43 where the ballast is cleaned by vibrational movement of the enclosure, and the cleaned ballast particles move down the screen to be deposited in hopper 54. Meanwhile, contaminants and debris are carried by the conveyor 114 at the bottom of the enclosure to the waste conveyor system 68 to be discharged away from the railroad bed.

Hopper 54 directs the cleaned ballast to the bottom conveyor system 62 which includes a longitudinally extending member which carries the cleaned ballast back to the rear hopper 58 where the clean ballast is discharged back onto the ballast bed. Meanwhile, the excavating member 66 removes the ballast from under the railroad ties and deposits the ballast onto the shoulder of the bed where this ballast is picked up by ditcher wheel 34 and emptied onto transverse conveyor system 46. Conveyor system 46 empties this dirty ballast onto conveyor system 48 which carries the dirty ballast rearwardly to be emptied into enclosure 50 to be vibrated and cleaned as previously discussed. Cleaned ballast from enclosure 50 is emptied into hopper 58 and returned to the track bed as discussed supra.

The ballast pick-up, cleaning, and conveying apparatus which is supported on frame 22 is similar to that carried on frame 20 and operates similarly. However, the apparatus carried on frame 22 is positioned on the side opposite to that of frame 20 so that ballast may be removed from beneath and adjacent to the opposite sides of the railroad bed simultaneously, thus eliminating the need for turning the apparatus around to make plural runs over the same area of track.

It is to be understood that while the frame means is described as being two vehicle frames 20 and 22, this is not to be held in a limiting sense, since a single frame may be utilized, if desired.

We claim:

1. Apparatus for reconditioning ballast along a railroad bed having track supporting cross ties carried thereon comprising:

vehicular support means including a frame disposed for movement along said railroad bed, said vehicular support means having first and second sides;

first excavating means for excavating ballast from adjacent the ends and beneath said cross ties, said first excavating means comprising first and second excavating wheels mounted in spaced relation on said first side of said vehicular support means and disposed for driven rotation for excavating ballast from adjacent the ends of said cross ties, and first undercutter means mounted between said first and second excavating wheels for excavating ballast from beneath said cross ties to be picked up by said second excavating wheel of said first excavating means;

cleaning station means including at least first and second discrete cleaning stations mounted on said frame of said vehicular support means, said first cleaning station disposed for receiving and cleaning ballast excavated by said first excavating wheel, and said second cleaning station disposed for receiving and cleaning ballast excavated by said second excavating wheel and said first undercutter means; and a first clean ballast conveyor means communicating with said first and second cleaning stations to receive said cleaned ballast from said first and second cleaning stations and for conveying said clean ballast back onto said railroad bed.

2. Apparatus as set forth in claim I including:

second excavating means for excavating ballast from adjacent to the ends and beneath said cross ties, said second excavating means comprising third and fourth excavating wheels mounted in spaced relation on said second side of said vehicular support means and disposed for driven rotation for excavating ballast from adjacent the end of said cross ties adjacent said second sides of said vehicular support means, and second undercutter means mounted between said third and fourth excavating wheels for excavating ballast from beneath said cross ties to be picked up by said fourth excavating wheel of said second excavating means;

said cleaning station means further including third and fourth discrete cleaning stations carried on said vehicular support means, said third cleaning station disposed for receiving and cleaning ballast excavated by said third excavating wheel, and said fourth cleaning station disposed for receiving and cleaning ballast excavated by said fourth excavating wheel and said second undercutter means; and second clean ballast conveyor means further communicating with said third and fourth cleaning stations to receive said cleaned ballast from said third and fourth cleaning stations along and for conveying the cleaned ballast back onto said railroad bed.

3. Apparatus as set forth in claim 2 including a first discrete ballast discharge means carried on said vehicular support means to receive cleaned ballast from said first and second cleaning stations and for directing said clean ballast back to said railroad bed; and a second discrete ballast discharge means carried on said vehicular support means to receive cleaned ballast from said third and fourth cleaning stations and for directing said clean ballast back to said railroad bed.

4. Apparatus as set forth in claim 3 wherein each said ballast discharge means includes a hopper carried by said vehicular support means.

5. Apparatus as set forth in claim 4 including first conveyor means for conveying ballast from said excavating wheels to their respective cleaning stations for reconditioning said ballast prior to the discharge thereof by said discharge means, said first conveyor means including a transverse conveyor means associated with each said excavating wheel for directly receiving ballast from the associated excavating wheel and a longitudinal conveyor associated with each said transverse conveyor means for receiving ballast from the associated transverse conveyor means and for directing said ballast to an associated cleaning enclosure.

6. Apparatus as set forth in claim 5 including contaminant discharge means associated with each said cleaning station to discharge the waste contaminants removed at each said cleaning station from said excavated ballast.

7. Apparatus as set forth in claim 6 wherein each said cleaning station comprises an enclosure having screen receiving means therein to receive said excavated ballast thereon, and a contaminant removal means to remove said contaminants from said enclosure, said enclosure disposed for vibratory movement to displace contaminants from said ballast onto said contaminant removal means.

8. Apparatus as set forth in claim 7 including actuating means for elevating each said enclosure to a predetermined operating elevation.

9. Apparatus as set forth in claim 8 wherein said predetermined operating level is in the range of 10° to 35°.

10. Apparatus as set forth in claim 9 wherein said vehicular support means is a pair of vehicle frames disposed in tandem relation, the first of said vehicle frames having said first and second cleaning stations mounted thereon in communication with said first excavating means to receive the excavated ballast therefrom, and the second of said vehicle frames having said third and fourth cleaning stations mounted thereon in communication with said second excavating means to receive the excavated ballast therefrom.

11. Apparatus as set forth in claim 2 wherein said vehicular support means is a pair of vehicle frames disposed in tandem relation, the first of said vehicle frames having said first and second cleaning stations mounted thereon in respective communication with said first and second excavating wheels to receive the excavated ballast therefrom, and the second of said vehicle frames having said third and fourth cleaning stations mounted thereon in communication with said third and fourth excavating wheels to receive the excavated ballast therefrom.

12. Apparatus for reconditioning ballast along a railroad bed having track support cross ties thereon comprising:

vehicular support means including a frame disposed for movement along said railroad bed, said vehicular support means having first and second sides;

first excavating means mounted on said first side of said frame of said vehicular support means for excavating ballast from adjacent to the ends and beneath said cross ties;

second excavating means mounted on said second side of said vehicular support means for excavating ballast from adjacent to the ends and beneath said cross ties;

first cleaning station means associated with said first excavating means for receiving and cleaning ballast excavated by said first excavating means;

second cleaning station means associated with said second excavating means for receiving and cleaning ballast excavated by said second excavating means;

first and second clean ballast discharge means for receiving and directing said excavated and cleaned ballast, respectively, from said first and second cleaning station means back onto said railroad bed responsive to cleaning thereof;

first conveyor means communicating between said first cleaning station means and said first clean ballast discharge means for conveying said clean ballast from said first cleaning station means to said first clean ballast discharge means; and second conveyor means communicating between said second cleaning station means and said second clean ballast discharge means for conveying said clean ballast from said second cleaning station means to said second clean ballast discharge means.

13. Apparatus as set forth in claim 12 wherein said first excavating means includes first and second excavating wheels mounted in spaced relation on said first side of said vehicular support means, and first undercutter means mounted in spaced relation with and between said first and second excavating wheels, said first undercutter means disposed for excavating ballast from beneath said cross ties for retrieval by said second excavating wheel.

14. Apparatus as set forth in claim 13 wherein said second excavating means includes third and fourth excavating wheels mounted in spaced relation on said second side of said vehicular support means, and second undercutter means mounted in spaced relation with and between said third and fourth excavating wheels, said second undercutter means disposed for excavating ballast from beneath said cross ties for retrieval by said fourth excavating wheel.

15. Apparatus as set forth in claim 13 wherein said first cleaning station means includes first and second discrete cleaning stations for respectively receiving and cleaning ballast excavated by said first and second excavating wheels and said first undercutter means.

16. Apparatus as set forth in claim 15 wherein said second cleaning station means includes third and fourth discrete cleaning stations for respectively receiving and cleaning ballast excavated by said third and fourth excavating wheels and said second undercutter means.

17. Apparatus as set forth in claim 12 wherein said first and second clean ballast discharge means each include a hopper having an outlet above said railroad bed, said outlet having controlled closure means for controlling the amount and direction of the discharged cleaned ballast.

* * * * *